US005249994A

United States Patent [19]

Finkl

[11] Patent Number: 5,249,994

[45] Date of Patent: Oct. 5, 1993

[54] SURFACE-DRIVE BOAT PROPULSION SYSTEM

[76] Inventor: Anthony W. Finkl, 445 E. Royal Flamingo Dr., Sarasota, Fla. 34236

[21] Appl. No.: 33,986

[22] Filed: Mar. 19, 1993

Related U.S. Application Data

[63] Continuation of Ser. No. 826,714, Jan. 28, 1992, abandoned.

[51] Int. Cl.[5] ..... B63H 5/06

[52] U.S. Cl. ..... 440/79; 440/112

[58] Field of Search ..... 440/49, 75, 66, 79, 440/69, 82, 112

[56] References Cited

U.S. PATENT DOCUMENTS

| | | | |
|---|---|---|---|
| 809,064 | 1/1906 | Johnson . | |
| 2,595,863 | 5/1952 | Loofbourrow . | |
| 3,938,463 | 2/1976 | Hecker et al. . | |
| 4,088,091 | 5/1978 | Smith | 440/69 |
| 4,383,828 | 5/1983 | Wynne | 440/69 |
| 4,428,734 | 1/1984 | Ludlow | 440/75 |
| 4,689,026 | 8/1987 | Small | 440/66 |
| 4,854,903 | 8/1989 | Sirois | 440/79 |

*Primary Examiner*—Jesus D. Sotelo
*Attorney, Agent, or Firm*—Baker & McKenzie

[57] ABSTRACT

An improved propulsion system is provided for inboard motor boats with planing-type hulls. A straight propeller shaft is passed through the bottom of the hull at an angle shallow enough to present a portion of the propeller above the bottom of the hull aft of the transom thereby providing a propeller that operates partially above the running water line during planing conditions. The benefits of a planing-type hull and a surface-drive propulsion system is economically and efficiently combined in a new design for inboard motor boats. The improved design is inexpensive to manufacture, install and maintain.

2 Claims, 1 Drawing Sheet

SURFACE-DRIVE BOAT PROPULSION SYSTEM

This application is a continuation of application Ser. No. 07/826,714, filed Jan. 28, 1992, now abandoned.

This invention relates to propulsion systems for boats and specifically to high performance propulsion systems for boats with inboard motors. The improvement contributed by this invention lies in a shallow-angled propeller shaft that passes through the hull of the boat, ahead of the transom, yet presents a portion of the propeller above the running water line and behind the transom.

BACKGROUND OF THE INVENTION

With the development of planing-type hulls and surface-drive propulsion systems, a problem arises when a designer attempts to combine the two performance enhancing features. Namely, prior to the development of the present invention, there was no inboard propulsion system where the propeller shaft passed directly from the transmission through the boat hull bottom ahead of the transom thereafter presenting a screw propeller partially above the running water line behind the transom. Solutions taught by the prior art either use jointed propeller shafts or pass the propeller shaft directly through the transom. Both of these solutions are inherently highly complicated and expensive.

An appreciation of the contribution of the present invention to the art of boat design comes with an understanding of the two performance enhancing features that the present invention allows a designer to combine. Namely, the present invention allows the boat manufacturer to combine a planing-type boat hull with a surface-drive propulsion system.

It is known that boats having planing hulls operate more efficiently at speeds where the hull "planes" on top of the surface of the water with a minimum area of the hull in contact with the water. The improved performance arises from the decreased drag attributable to the propeller operating partly above the water. Minimizing drag increases speed and fuel efficiency. Typically, about one-half to two-thirds of a planing hull is in contact with the water surface at planing speeds. With "V" shaped hulls, only the area proximate to the keel is in contact with the water surface during planing. However, the wetted area of the hull varies depending upon the design and speed of the vessel. As much as three-quarters of the hull area may be wetted at lower speeds, and as little as one-fourth of the hull area may be wetted during very high speed cruising. Hull designs of this type, that allow the boat to plane, are known in the art as planning-type hulls.

The second design feature successfully utilized by this invention is the surface-drive propulsion system for an inboard motor boat. When a propeller is presented partially above the extended plane of the bottom of the boat, a portion of the propeller is above the "running water line" when the boat attains the planing condition. By presenting a portion of the propeller above the running water line (and therefore above the surface of the water) during the planing condition, a more effective propeller thrust is transmitted to the boat resulting in additional boat speed without increased use of engine power. The accepted physical explanation for the increase in the propeller's thrust efficiency when operating partially above the running water line is that there is less peripheral water friction operating on the propeller blades as the portion of those blades are no longer continuously submerged under the surface of the water.

Regardless of the exact physical explanation for the above phenomena, surface-drive propulsion systems are effective in increasing boat speed without using additional engine power. The combination of a planing hull and a surface-drive propulsion system provide an effective and efficient use of a boat engine's power.

For boats with inboard motors, the surface-drive propulsion system has been limited in its application because an economical design of a propeller shaft extending from an inboard motor that presents a portion of the propeller above the running water line was not available. The three designs currently employed are all inherently impractical to build and maintain.

First, a surface-drive system can be employed with an inboard motor when the propeller shaft passes through the transom. This design scheme is impractical and expensive because piercing the transom with the propeller shaft requires specially fabricated hardware including shaft parts, radial thrust bearings and special packing glands. Because specially designed hardware is required to pass a propeller through the transom and these parts must be maintained and replaced during normal maintenance, this design is not only expensive initially but is also expensive to maintain and operate.

Second, in order to avoid passing the propeller shaft through the transom, manufacturers have designed propeller shafts with special universal joints and special couplings thereby creating a jointed shaft that extends through the hull of the boat and then angles rearward in a parallel fashion in order to present the propeller blades partially above the keel and running water line. This design scheme is also expensive and impractical. The special universal joints and couplings required between the propeller and transmission are expensive to manufacture and also expensive to maintain.

Finally, a third design employs one or two inboard engines mounted near the transom with an output shaft extending forward toward the bow. A double universal joint coupling mechanism connects the forwardly extending output shaft to two rearwardly extending propeller shafts. The dual rearwardly extending propeller shafts extend through the rear of the hull without penetrating the transom. However, the dual propeller shafts and special couplings associated with this design also suffer from high initial investment costs and high maintenance costs.

Thus, there is a need for a boat with an inboard motor that employs a single, straight conventional propeller shaft that extends through the bottom of the hull and still presents a portion of the propeller above the running water line, all in combination with the planing-type hull. Only in this manner can the two aforenoted design features, namely planing-type hulls and surface-drive propulsion systems, be combined with inexpensive inboard boat designs and standard marine hardware.

BRIEF DESCRIPTION OF THE INVENTION

The improved surface-drive propulsion system for inboard boats with planing-type hulls of this invention is provided without using special couplings in the propeller shaft or passing the propeller shaft through the transom. An inboard engine is provided with a transmission and a straight propeller shaft extends rearward from the engine towards the stern of the boat. The propeller shaft passes through the bottom of the hull forward of the transom at an angle whereby the propeller is disposed behind the transom and a portion of the propeller is presented above the lower "V" section of the transom where the keel and transom intersect. Therefore, an inboard boat propulsion system is provided with a single straight rearwardly extending propeller shaft that extends through the rear portion of the hull an still provides a propeller rearwardly of the transom, with a portion of the propeller presented above the running water line during planing operation of the boat hull.

It is therefore a general object of the present invention to provide a surface-drive propulsion system for inboard motor boats with planing-type hulls with a simplified mechanical design.

A related object is to provide a propulsion system for an inboard boat with reduced draft.

Another related object is to provide a surface-drive propulsion system for inboard boats with planing-type hulls that achieves the planing condition at lower rpms than currently available surface drive systems.

It is also an object of the invention to provide a surface-drive propulsion system for inboard boats with planing hulls that employs conventional marine hardware.

A still further object is to provide a shallow-angled propeller shaft with increased horizontal thrust of the propeller.

Other objects and advantages of the invention will be apparent to those of ordinary skill in this art from the following detailed description of the invention.

BRIEF DESCRIPTION OF THE DRAWINGS

This invention is illustrated more or less diagrammatically in the accompanying drawings wherein.

DETAILED DESCRIPTION OF THE INVENTION

Figure 1:
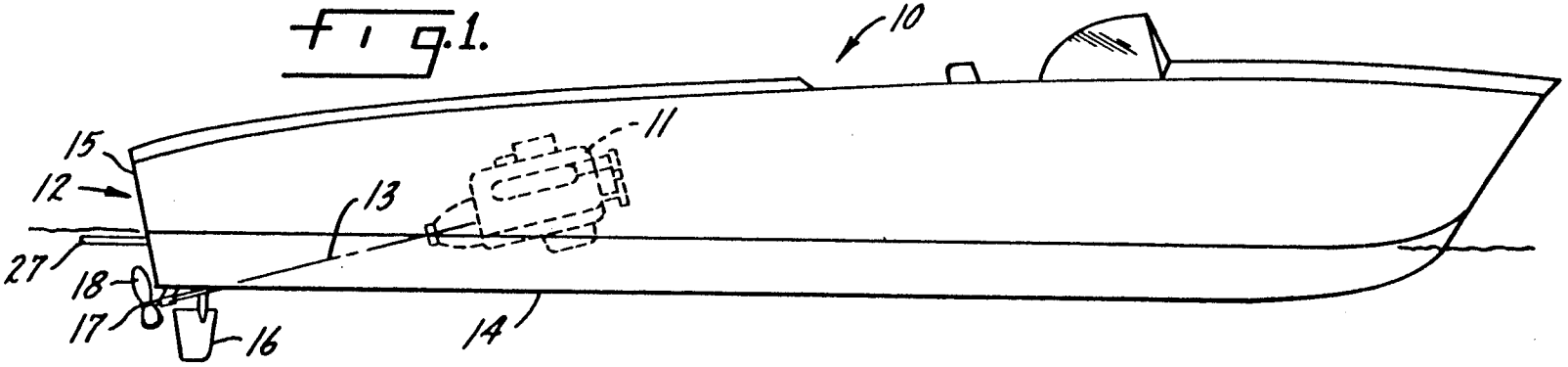
FIG. 1 is a starboard side view of an inboard motor boat that is at rest and is equipped with the improved surface-drive propulsion system of the present invention.

Like reference numerals will be used to refer to like or similar parts from Figure to Figure in the following description of the drawings.

Prior to the development of this invention, planing-type hulls and surface-drive propulsion systems were never effectively combined for inboard motor boats. The present invention solves this problem in an inexpensive and efficient manner.

FIG. 1 is a starboard side view of an inboard motor boat incorporating the present invention. The inboard engine 11 is conventionally mounted a short distance ahead of the stern 12. A straight propeller shaft 13 extends down through the hull bottom 14 ahead of the transom 15. Note that the propeller shaft 13 is of a straight-line configuration and is not jointed or angled. Since the propeller shaft 13 is provided without any special universal joints or couplings, it is less expensive to manufacture and maintain.

Also shown in FIG. 1 is the rudder 16 and propeller 17. The upwardly extending propeller blade 18 is presented partially above the bottom of the hull 14 and therefore partially above the running water line during planing conditions.

Figure 2:
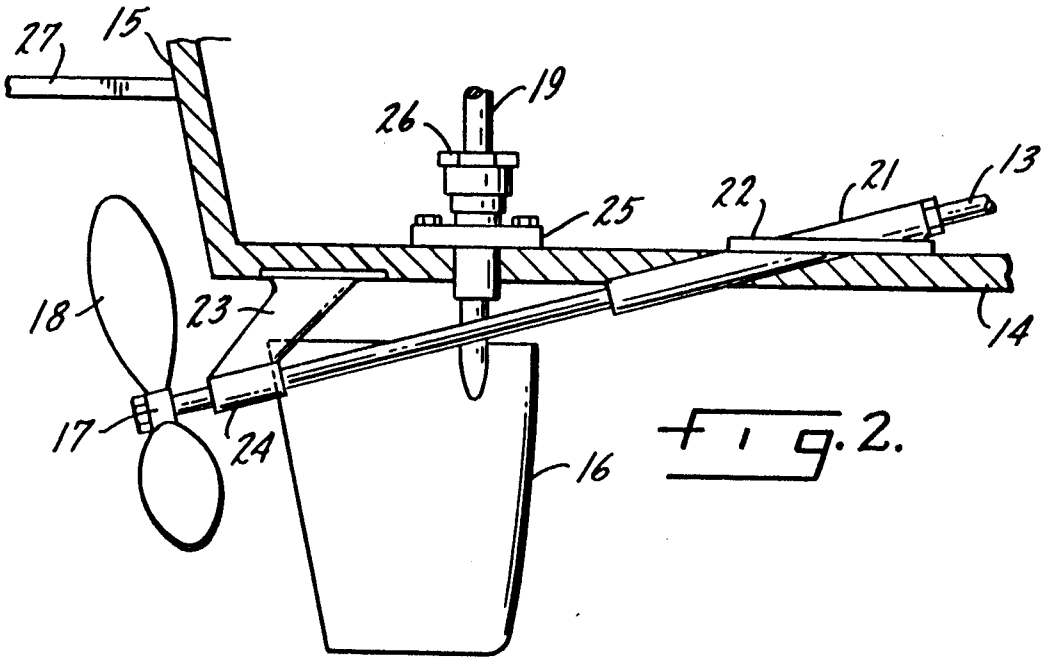
FIG. 2 is an expanded view, partially in section, of the aft end of the propeller shaft, the rudder shaft, strut bearing and propeller of the surface-drive propulsion system shown in FIG. 1.

FIG. 2 shows an expanded view of the propeller 18, propeller shaft 13, rudder 16 and other hardware associated with these three parts. Propeller shaft 13 extends rearwardly from the engine 11 through the hull bottom 14 ahead of the transom 15. An arrangement whereby the propeller shaft 13 is passed through the hull bottom 14, as opposed to the transom 15, is less expensive to manufacture and maintain. When a propeller shaft 13 is passed through a transom 15, special shaft ports, radial thrust bearings and packing glands are required. In contrast, this invention passes the propeller shaft 13 through the hul bottom 14 and employs a conventional shaft log 21 and a conventional packing gland 22. The shaft log 21 and the packing gland 22 are standard, conventional parts and therefore can be replaced at a lower cost than the special shaft ports, thrust bearings and packing glands required to pass a propeller shaft 13 through a transom 15. Thus, the present invention is less expensive initially and lessens the future cost of maintenance.

The propeller shaft 13 is supported by a conventional strut 23 and a conventional strut bearing 24. The length of the strut 23 is significantly less than conventional inboard motorboat designs thereby reducing water resistance. The distance between the propeller 18 and the strut bearing 24 is short thereby reducing propeller shaft vibration and fatigue. The transverse step 27 eliminates the spray or rooster tail caused by surface-drive propellers 17.

Also shown in FIG. 2 is the rudder 16 and the rudder shaft 19. The rudder shaft 19 and the rudder 16 are supported by the through-hull fitting 25 and the hex nut 26. A packing gland (not shown) provides a seal between the through-hull fitting 25, the rudder shaft 19 and the hex nut 26.

An alternative embodiment employs a dual rudder steering mechanism (not shown) as opposed to the single rudder 16. The dual rudders are disposed on either side of the propeller 17 and provide outstanding directional control when operating astern.

Inboard motor boats now may come equipped with planing hulls and surface-drive propulsion systems via a design that is less expensive to manufacture and maintain than known before. The inherent disadvantages of passing the propeller shaft through the transom are avoided as are the disadvantages of employing an angled propeller shaft.

Further, the shallow angle of the propeller shaft 13 reduces the draft of the inboard motorboat 10 by at least five inches. Because the rudder must be disposed below the propeller 17, raising the propeller 17 enables the designer to raise the propeller. For example, a twenty-six foot inboard boat with a "V" shaped hull and equipped with the present invention has a draft, measured from the bottom of the hull to the bottom of the rudder, of only two feet, one inch. In contrast, a conventional twenty-six foot inboard with the same hull but employing a standard inboard design with the propeller passing through the hull has a draft of two feet, eight inches.

Although a preferred embodiment of the present invention has been illustrated and described, it will at once be apparent to those skilled in the art that variations may be made within the spirit and scope of the invention. Accordingly, it is intended that the scope of the invention be limited solely by the scope of the hereafter appended claims and not by the specific wording in the foregoing description.

I claim:

1. An improved surface-drive propulsion system for an inboard motor boat, the boat including a hull-transom junction where the hull is connected to the transom, a motor, the motor being disposed aft of a mid-section, the mid-section being disposed between the stern and the bow of the boat;

a transmission, the transmission disposed between the motor and the stern;

a propeller shaft, the propeller shaft being straight in configuration and providing a non-jointed connection between the transmission and a propeller, the propeller shaft passing through the bottom of the hull ahead of the transom, a first end of the propeller shaft being connected to the transmission, the second end of the propeller shaft being connected to the propeller;

the bottom of the hull being devoid of any tunnels or grooves for accommodating the propeller shaft, the propeller shaft passing through a shaft log, the shaft log passing through a packing gland, the shaft log and packing gland being disposed at the hull where the propeller shaft passes through the hull;

the propeller and the second end of the propeller shaft being disposed aft of the transom, at least a portion of the propeller being disposed above the hull-transom junction and at least a portion of the propeller operating above the running surface of the water during planing operation of the boat.

2. An inboard motor boat with an improved propulsion system, the boat comprising:

a stern, a bow and a midsection disposed therebetween:

a hull having a bottom, the hull connected to a transom at a hull-transom junction, the hull being generally V-shaped and being absent of any tunnels for accommodating a portion of a propeller shaft;

a motor, the motor disposed between the midsection and the stern;

a transmission, the transmission disposed between the motor and the stern;

a propeller shaft providing a straight connection between the transmission and a propeller, the propeller shaft passing through the bottom of the hull ahead of the transom;

at least a portion of the propeller shaft and all of the propeller being disposed aft of the hull-transom junction, at least a portion of the propeller being disposed above the hull-transom junction; and at least a portion of the propeller operating above the hull-transom junction during planing operation of the boat, whereby at least a portion of the propeller operating above the running water line during planing operation of the boat.

* * * * *